US010420383B2

(12) United States Patent
Lewis et al.

(10) Patent No.: US 10,420,383 B2
(45) Date of Patent: Sep. 24, 2019

(54) GARMENT AND ACCESSORY ATTACHMENT FOR DISPLAYING ADORNMENTS, MESSAGES, AND LOGOS

(71) Applicants: Stephen Lewis, Pacific Palisades, CA (US); Arthur Snyder, Los Angeles, CA (US)

(72) Inventors: Stephen Lewis, Pacific Palisades, CA (US); Arthur Snyder, Los Angeles, CA (US)

( * ) Notice: Subject to any disclaimer, the term of this patent is extended or adjusted under 35 U.S.C. 154(b) by 180 days.

(21) Appl. No.: 15/593,664

(22) Filed: May 12, 2017

(65) Prior Publication Data

US 2017/0325527 A1 Nov. 16, 2017

Related U.S. Application Data

(60) Provisional application No. 62/335,183, filed on May 12, 2016.

(51) Int. Cl.

| | |
|---|---|
| ***G09F 3/20*** | (2006.01) |
| ***A41D 27/08*** | (2006.01) |
| ***A43B 23/24*** | (2006.01) |
| ***A44C 3/00*** | (2006.01) |
| ***A43B 3/00*** | (2006.01) |
| ***G09F 21/02*** | (2006.01) |

(52) U.S. Cl.

CPC ..... *A41D 27/08* (2013.01); *A43B 3/0078* (2013.01); *A43B 23/24* (2013.01); *A44C 3/001* (2013.01); *G09F 3/207* (2013.01); *G09F 21/02* (2013.01)

(58) Field of Classification Search

USPC ..... 40/661.04

See application file for complete search history.

(56) References Cited

U.S. PATENT DOCUMENTS

| | | | | |
|---|---|---|---|---|
| 1,567,406 | A * | 12/1925 | Wilke | B42D 5/001 281/19.1 |
| 6,023,864 | A * | 2/2000 | Liebenow | G09F 3/16 24/482 |
| 6,105,294 | A * | 8/2000 | Goodfellow | G09F 3/20 206/39.5 |
| 2007/0271829 | A1* | 11/2007 | Knight | G09F 1/12 40/654.01 |
| 2009/0056177 | A1* | 3/2009 | Mallozzi | G09F 3/207 40/1.6 |

(Continued)

*Primary Examiner* — Kristina N Junge

(57) ABSTRACT

A garment and accessory attachment for displaying adornments, messages, and logos is used to display reminder or reinforcement messages to a user. The garment and accessory attachment attaches to garments or accessories including, but not limited to, clothing, shoes, and athletic bags. garment and accessory attachment incorporates an adornment, message, or logo superimposed onto an interchangeable image tag to remind or reinforce a thought process to encourage specific behavior or focus to improve the user's performance. The image tag is pressed against a clip base of the garment and accessory attachment and secured with a first tag restraint and a second tag restraint of the garment and accessory attachment. The garment and accessory attachment is mounted to a garment or accessory through a clip arm. The clip arm is adjacently connected to the clip base, opposite to the first tag restraint and the second tag restraint.

6 Claims, 8 Drawing Sheets

(56) References Cited

U.S. PATENT DOCUMENTS

| | | | | |
|---|---|---|---|---|
| 2010/0000133 | A1* | 1/2010 | Kent | G09F 3/20<br>40/124.02 |
| 2011/0265363 | A1* | 11/2011 | Oliver-Collins | G09F 3/20<br>40/642.01 |
| 2011/0296728 | A1* | 12/2011 | Bolt | G09F 3/14<br>40/649 |
| 2012/0030978 | A1* | 2/2012 | Miller | G09F 7/18<br>40/594 |
| 2012/0222787 | A1* | 9/2012 | Caron | A45C 11/182<br>150/147 |

* cited by examiner

GARMENT AND ACCESSORY ATTACHMENT FOR DISPLAYING ADORNMENTS, MESSAGES, AND LOGOS

The current application claims a priority to the U.S. Provisional Patent application Ser. No. 62/335,183 filed on May 12, 2016.

FIELD OF THE INVENTION

The present invention relates generally to a garment and accessory attachment. More specifically, the present invention is a garment and accessory attachment that displays interchangeable adornments, messages, and logos for fashion or while playing a sport, such as golf, baseball, or tennis.

BACKGROUND OF THE INVENTION

Golf legends and professionals advocate keeping one or two thoughts related to your swing in mind as you play. There is a benefit to a golfer to have a physical reminder on their shoes in order to remind the athlete of the mental cue to help develop the best possible swing. In the game of golf there is a need for a tool that reminds the golfer to stay calm, breathe, stay down, focus, finish their swing, and other reminders that the golfer would see when she or he looks down at their shoes before she or he would begin their swing.

The same is true for that of a baseball player or tennis player, in that there is a benefit for a tool that reminds the athlete to stay focused on their swing. The same is also true for every athlete in that there is a need to constantly train the mind to focus to create beneficial results for the athletes' performance.

Due to these circumstances, there is a benefit for the athlete to have a choice in the message, as each athlete could have a different aspect of their swing or their mentality to work on.

The present invention solves the problem by having a component that is easily affixed to shoes, apparel, or other sport accessories. The message or logo elevates the person's performance in their sport by displaying a specific mental cue that is easily visible to the athlete, and reinforces mental cues that helps the athlete perform by clipping onto one or more shoelaces of a shoe. Each mental cue is printed on a label that can be easily secured to the present invention between the clip base and each of a first tag restraint and a second tag restraint. The present invention is easily secured to a garment or accessory, such as one or more shoelaces of a shoe, through a clip arm or by a tether through a mounting aperture. The interchangeable labels help remind the athlete with messages such as one or more of the following: tempo, tum, posture, breathe, focus, back and thru, alignment, hit down, smooth, impact, soft hands, commit, trust, stay down, finish, visualize, and swing plane. The present invention solves the problem by having these labels customized to be available in any language, font, color, symbol, and/or combination thereof.

DETAIL DESCRIPTIONS OF THE INVENTION

All illustrations of the drawings are for the purpose of describing selected versions of the present invention and are not intended to limit the scope of the present invention.

The present invention is a garment and accessory attachment for displaying adornments, messages, and logos. The present invention attaches to garments or accessories including, but not limited to, clothing, shoes, and athletic bags. The present invention incorporates an adornment, message, or logo to remind or reinforce a thought process to encourage specific behavior or focus for a technique to improve the user's performance.

Figure 1:
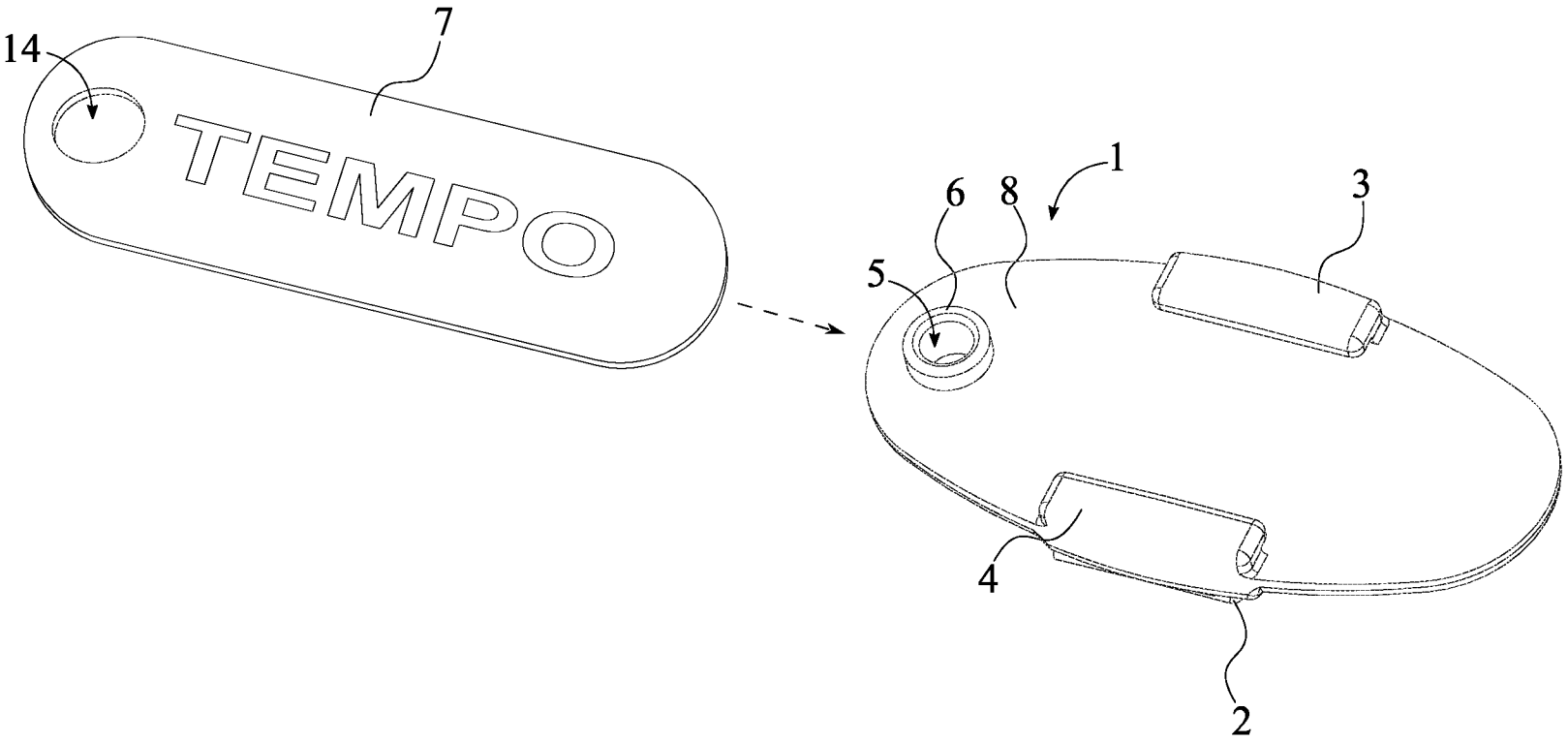
FIG. 1 is a perspective view of the present invention wherein the image tag is being inserted between the clip base and the first tag restraint and between the clip base and the second tag restraint.

In accordance to FIG. 1, the present invention comprises a clip base 1, a clip arm 2, a first tag restraint 3, a second tag restraint 4, and a mounting aperture 5. The clip base 1 supports an image tag 7 to be displayed to the user. The clip arm 2 secures the present invention to garments and accessories, for example to the shoelaces of shoes. The clip arm 2 is mounted to the clip base 1. The clip arm 2 is centrally positioned along the clip base 1 such that the present invention is balanced when mounted onto a garment or accessory. The first tag restraint 3 and the second tag restraint 4 secure the image tag 7 against the clip base 1, as shown in FIG. 9. Detailed in FIG. 1, FIG. 7, and FIG. 8, the first tag restraint 3 is adjacently connected to the clip base 1. Similarly, the second tag restraint 4 is adjacently connected to the clip base 1. The second tag restraint 4 is oppositely positioned to the first tag restraint 3, across the clip base 1. The first tag restraint 3 and the second tag restraint 4 are oppositely oriented to the clip arm 2, across the clip base 1, in accordance to FIG. 1, FIG. 2, FIG. 5, FIG. 7, and FIG. 8. The mounting aperture 5 allows the present invention to be secured, through a keyring, a tether, a cord, or a similar tiedown, to a garment or an accessory. As shown in FIG. 1, FIG. 2, FIG. 5, and FIG. 6, the mounting aperture 5 traverses through the clip base 1 in order to receive a tiedown to affix the present invention to a garment or accessory. The mounting aperture 5 is offset from the clip arm 2 such that a tie down traversing through the mounting aperture 5 does not obscure the image tag 7, when the image tag 7 is pressed against the front face 8 for display.

Figure 2:
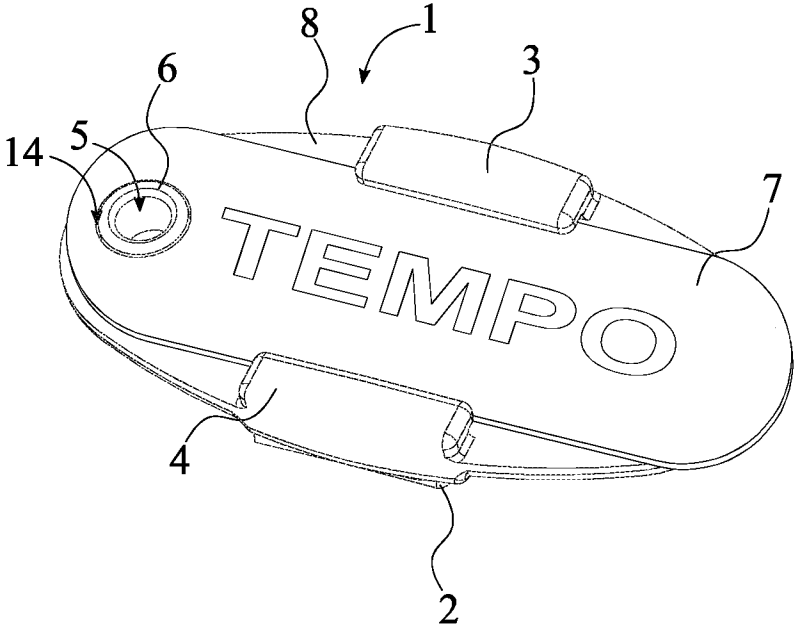
FIG. 2 is a perspective view of the present invention wherein the image tag is positioned against the clip base, engaging the first tag restraint and the second tag restraint, and engaging the aperture lip.
Figure 3:
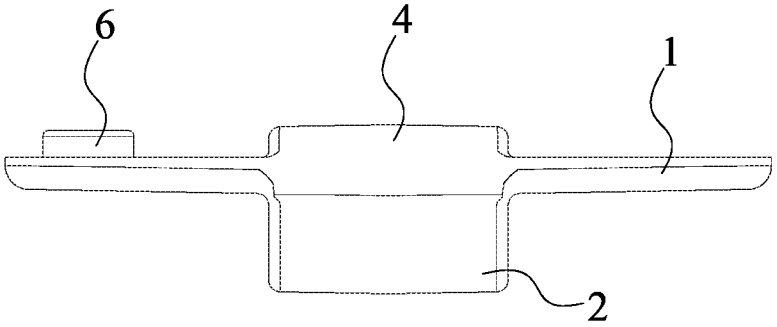
FIG. 3 is a front view of the present invention.
Figure 4:
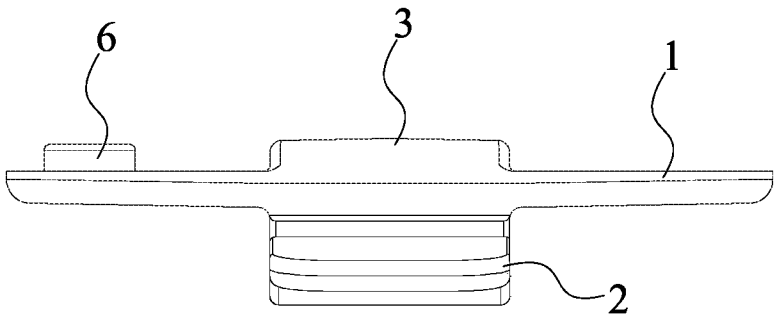
FIG. 4 is a rear view of the present invention.
Figure 5:
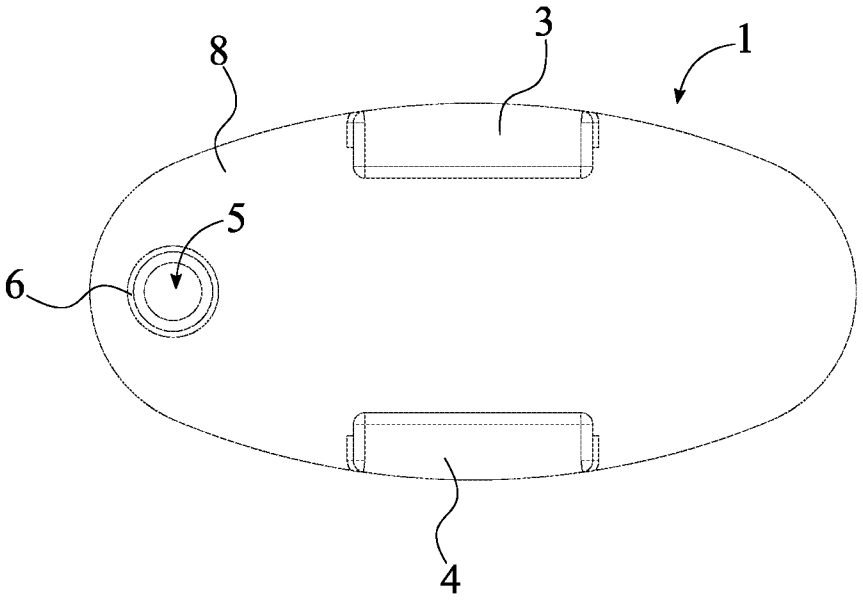
FIG. 5 is a top view of the present invention.
Figure 6:
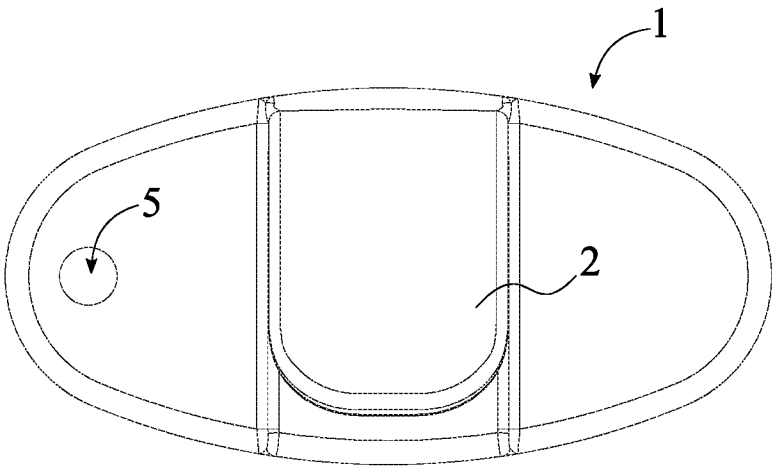
FIG. 6 is a bottom view of the present invention.

Further in accordance to the preferred embodiment of the present invention, the clip base 1 comprises a front face 8, detailed in FIG. 1, FIG. 2, and FIG. 5. The front face 8 is an externally oriented surface of the clip base 1 as the present invention is mounted onto a garment or accessory that the image tag 7 is pressed against for display. The first tag restraint 3 and the second tag restraint 4 are adjacently connected to the front face 8 in order to secure the image tag 7 to the front face 8. The mounting aperture 5 is normal to the front face 8 such that a tiedown is easily inserted or removed from the mounting aperture 5.

Figure 7:
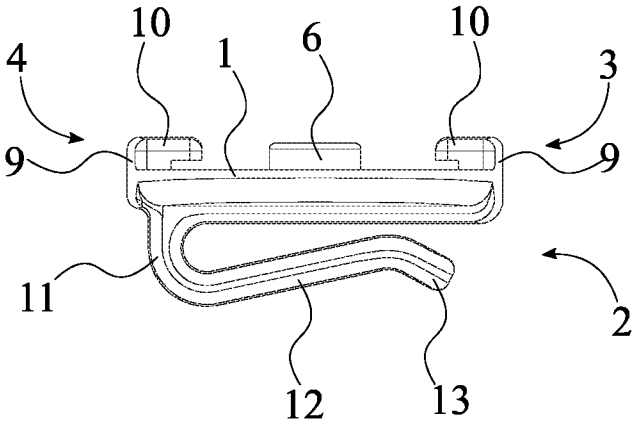
FIG. 7 is a right view of the present invention.
Figure 8:
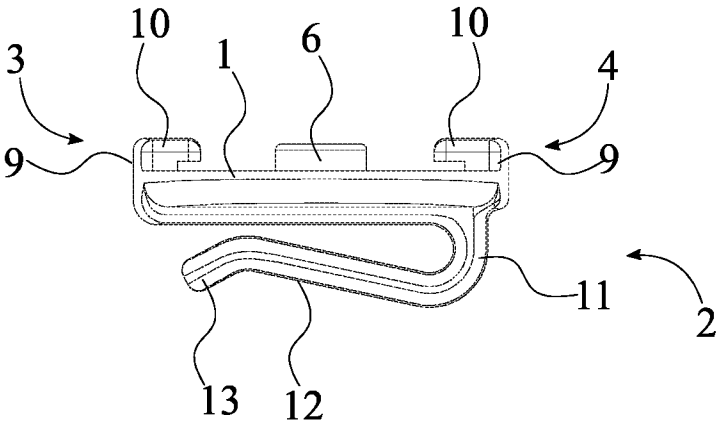
FIG. 8 is a left view of the present invention.

More specifically, the first tag restraint 3 comprises a base mount 9 and a tag-restraint extrusion 10, in accordance to FIG. 7 and FIG. 8. The base mount 9 is adjacently connected to the clip base 1 to mount the tag-restraint extrusion 10 to the clip base 1. The tag-restraint extrusion 10 is adjacently connected to the base mount 9. The tag-restraint extrusion 10 is oppositely positioned with the clip base 1 along the base mount 9. The tag-restraint extrusion 10 is oriented parallel to the clip base 1. In conjunction with the second tag restraint 4, this configuration prevents the image tag 7 from being dislodged normal to the clip base 1.

Similarly, the second tag restraint 4 comprises a base mount 9 and a tag-restraint extrusion 10, in accordance to FIG. 7 and FIG. 8. The base mount 9 is adjacently connected to the clip base 1 to mount the tag-restraint extrusion 10 to the clip base 1. The tag-restraint extrusion 10 is adjacently connected to the base mount 9. The tag-restraint extrusion 10 is oppositely positioned with the clip base 1 along the base mount 9. The tag-restraint extrusion 10 is oriented parallel to the clip base 1. In conjunction with the first tag restraint 3, this configuration prevents the image tag 7 from being dislodged normal to the clip base 1.

Still in accordance to the preferred embodiment of the present invention, the present invention comprises an aperture lip 6, shown in FIG. 1 to FIG. 5, FIG. 7, and FIG. 8. The aperture lip 6 assists in affixing the image tag 7 onto the clip. The aperture lip 6 is adjacently connected to the clip base 1. The aperture lip 6 is oppositely positioned with the clip arm 2 about the clip base 1. The aperture lip 6 is perimetrically positioned about the mounting aperture 5, as shown in FIG. 1. The aperture lip 6 extrudes from the clip base 1 to prevent the image tag 7 from lateral displacement due to undesired shear stress as an alignment aperture 14 of the image tag 7 is positioned about the aperture lip 6.

In accordance to FIG. 7 and FIG. 8, the clip arm 2 comprises an arm mount 11, a restraining portion 12 and a receiving portion 13. The arm mount 11 offsets the restraining portion 12 and the receiving portion 13 from the clip base 1 such that the clip arm 2 is able to receive and secure the present invention onto a garment or accessory, for example to the shoelaces of shoes. The arm mount 11 is adjacently connected to the clip base 1. The restraining portion 12 is adjacently connected to the arm mount 11, opposite to the clip base 1. The restraining portion 12 is oriented towards the clip base 1. This orientation of the restraining portion 12 allows the clip arm 2 to exert pressure on the garment or accessory to maintain the connection between the present invention and the garment or accessory. The receiving portion 13 is adjacently connected to the restraining portion 12, opposite to the arm mount 11. The receiving portion 13 is oriented away from the clip base 1. This orientation allows the present invention to be positioned about a portion of a garment or accessory, for example to the shoelaces of shoes, in order for the clip arm 2 to frictionally engage the garment or accessory.

In implementation of the present invention with a shoe, a shoelace is inserted into the present invention between the clip base 1 and the receiving portion 13, to be positioned between the clip base 1 and the restraining portion 12. With the present invention being secured about the shoelace, the front face 8 is oriented towards the head of the user such that an image tag 7 is visible to the user, as the user looks towards the ground at the beginning of a golf swing, for instance.

Further in accordance to the preferred embodiment of the present invention, the present invention comprises an image tag 7, shown in FIG. 1 and FIG. 2. The image tag 7 is preferred to be a label, image, or short message to convey or reinforce a thought related to the user's task. The image tag 7 may include a text message, such as "Balance", "Breathing", "Tempo", or similar words or phrases; logo for an affiliated sporting team or brand; or any mnemonic trigger word or symbol. The image tag 7 is pressed against the front face 8. The image tag 7 comprises an alignment aperture 14. The alignment aperture 14 secures the image tag 7 about the aperture lip 6, as well as, allowing the image tag 7 to be secured onto a keyring, a tether, a cord, or a similar tiedown such that the image tag 7 is able to be transported along with the clip base 1. The alignment aperture 14 is concentrically positioned with the mounting aperture 5, circumscribing the aperture lip 6 such that the aperture lip 6 secures the image tag 7 on the clip base 1. The image tag 7 slideably engages the first tag restraint 3 and the second tag restraint 4 in order to keep the image tag 7 within the boundaries for a profile of the clip base 1, as well as to prevent the image tag 7 from being dislodged normal to the clip base 1.

Although the invention has been explained in relation to its preferred embodiment, it is to be understood that many other possible modifications and variations can be made without departing from the spirit and scope of the invention as hereinafter claimed.

What is claimed is:

1. A garment and accessory attachment comprising:
a clip base;
a clip arm;
a first tag restraint;
a second tag restraint;
a mounting aperture;
an aperture lip;
an image tag;
the clip base comprising a front face and a rear face;
the front face and the rear face being oppositely located to each other;
the clip arm being mounted to the rear face;
the clip arm being centrally positioned along the rear face;
the first tag restraint being connected to the front face;
the second tag restraint being connected to the front face;
the second tag restraint being oppositely positioned with the first tag restraint across the clip base;
the first tag restraint and the second tag restraint being centrally positioned across the clip base;
the first tag restraint and the second tag restraint being oppositely oriented to the clip arm about the clip base;
the mounting aperture traversing through the front face and the rear face;
the aperture lip being connected to the front face;
the aperture lip being oppositely positioned with the clip arm about the clip base;
the aperture lip being perimetrically positioned about the mounting aperture;
the image tag being pressed against the front face;
the image tag slideably engaging the first tag restraint and the second tag restraint in order to keep the image tag within boundaries for a profile of the clip base and to prevent the image tag from being dislodged normal to the clip base;
the image tag comprising an alignment aperture;
the alignment aperture being concentrically positioned with the mounting aperture;
the aperture lip being removably inserted into the alignment aperture;
the clip arm comprising an arm mount, a restraining portion and a receiving portion;
the arm mount being connected to the rear face;
the restraining portion being connected to the arm mount opposite to the rear face;
the receiving portion being connected to the restraining portion opposite to the arm mount; and the restraining portion and the receiving portion extending in a direction from the second tag restraint to the first tag restraint.

2. The garment and accessory attachment as claimed in claim 1 comprising:

the mounting aperture being oriented normal to the front face and the rear face.

3. The garment and accessory attachment as claimed in claim 1 comprising:

the mounting aperture being offset from the clip arm.

4. The garment and accessory attachment as claimed in claim 1 comprising:

the first tag restraint comprising a first base mount and a first tag-restraint extrusion;

the first base mount being connected to the front face;

the first tag-restraint extrusion being connected to the first base mount;

the first tag-restraint extrusion being oppositely positioned with the front face along the first base mount;

the first tag-restraint extrusion being oriented parallel to the front face;

the second tag restraint comprising a second base mount and a second tag-restraint extrusion;

the second base mount being connected to the front face;

the second tag-restraint extrusion being connected to the second base mount;

the second tag-restraint extrusion being oppositely positioned with the front face along the second base mount; and the second tag-restraint extrusion being oriented parallel to the front face.

5. The garment and accessory attachment as claimed in claim 1 comprising:

the restraining portion being oriented towards the clip base.

6. The garment and accessory attachment as claimed in claim 1 comprising:

the receiving portion being oriented away from the clip base.

* * * * *